US008181563B1

(12) United States Patent
Peterken

(10) Patent No.: US 8,181,563 B1
(45) Date of Patent: May 22, 2012

(54) GAS TAPPET SYSTEM FOR A RIFLE

(75) Inventor: William H. Peterken, Freeman Township, ME (US)

(73) Assignee: Technical Armament Solutions, LLC, East Berlin, CT (US)

( * ) Notice: Subject to any disclaimer, the term of this patent is extended or adjusted under 35 U.S.C. 154(b) by 296 days.

(21) Appl. No.: 12/583,470

(22) Filed: Aug. 21, 2009

Related U.S. Application Data

(66) Substitute for application No. 61/190,133, filed on Aug. 26, 2008.

(51) Int. Cl.
*F41A 5/00* (2006.01)

(52) U.S. Cl. ..... 89/191.01; 89/191.02

(58) Field of Classification Search ..... 89/125, 89/191.01, 191.02, 193, 192; 403/346, 364
See application file for complete search history.

(56) References Cited

U.S. PATENT DOCUMENTS

| | | | | |
|---|---|---|---|---|
| 5,351,598 | A * | 10/1994 | Schuetz | 89/185 |
| 2006/0065112 | A1* | 3/2006 | Kuczynko et al. | 89/193 |
| 2008/0276797 | A1* | 11/2008 | Leitner-Wise | 89/191.01 |
| 2009/0223357 | A1* | 9/2009 | Herring | 89/192 |
| 2010/0300277 | A1* | 12/2010 | Hochstrate et al. | 89/179 |
| 2010/0319528 | A1* | 12/2010 | Kenney et al. | 89/193 |

* cited by examiner

*Primary Examiner* — Gabriel Klein
(74) *Attorney, Agent, or Firm* — Fattibene and Fattibene LLC; Paul A. Fattibene

(57) ABSTRACT

A gas tappet system for use in an M16, M4, or AR-15 type rifle having a detachable piston eccentrically connected to an operating rod. A piston having a plenum therein and a releasably attached operating rod uses combustion or propellant gasses to move the piston in a long stroke, preventing damaging impulses to the bolt carrier and cycling rounds for automatic or semi-automatic fire. The operating rod, piston, cylinder, and mounting clamp permit easy installation on the rifle without any modification and can easily be removed for reinstallation of the original direct gas impingement system.

18 Claims, 8 Drawing Sheets

GAS TAPPET SYSTEM FOR A RIFLE

RELATED APPLICATION

This application claims the benefit of U.S. Provisional Application No. 61/190,133 filed Aug. 26, 2008.

FIELD OF THE INVENTION

The present invention relates in general to a modification of an M16, M4, or AR-15-type rifle, and more particularly to an improved system for introducing a cartridge and ejecting the casing.

BACKGROUND OF THE INVENTION

Many firearms, including the M-16, M-4 and AR-15 rifles, use a direct gas system for ejecting a spent cartridge, resetting a trigger mechanism, and cycling a new round for firing. The direct gas system utilizes a tube that has an inlet port in the barrel of the gun such that when a bullet passes the inlet port combustion or propellant gasses enter the gas tube and are directed back to the bolt carrier to cycle the action for the firing of another round. The use of combustion or propellant gasses results in significant quantities of propellant residue being deposited in and on the bolt carrier as well as in the action. The combustion or propellant gasses fill the interior of the action after the carrier key is displaced away from the end of the gas tube, resulting in propellant or combustion gasses being distributed throughout the upper and lower receivers. As a result, combustion or propellant gas residue builds up on the bore of the bolt carrier. Additionally, considerable heat is transferred to the upper and lower receivers as well as the bolt and the bolt carrier and related parts. In an effort to prevent the build up and corrosion that results from the combustion of propellant gasses, the bolt carrier and bolt are usually heavily lubricated. When the firearm is used in dirty or sandy conditions, fine particles of dirt or sand may adhere to the lubricant, creating abrasive slurry and resulting in jamming of the action and possible misfires. Additionally, heat buildup may cause parts to prematurely fatigue and fail. While these direct gas systems for recycling a round for automatic firing are relatively simple, they often require frequent and meticulous maintenance so as to maintain the firearm in a reliable condition and prevent jamming or misfiring.

Efforts have been made to improve on the direct gas system. One such system is a gas tappet system having a cylinder and piston with a connected operating rod to move the bolt carrier. These prior gas tappet systems often require extensive modification of an existing firearm to install. For example, often the small hole in the upper receiver that permits passage of the gas tube in a direct gas system has to be modified and substantially enlarged so as to accommodate the much larger diameter piston that is necessary in a gas tappet system. Accordingly, once modified, it is difficult or impossible to remove the gas tappet system and reinstall the original direct gas system into the firearm. Additionally, many prior gas tappet systems utilize a short stroke piston and operating rod that rely on a large impact force and inertia to move a bolt and bolt carrier. Since the operating rod often impacts the bolt carrier at the top of the bolt carrier and not along a center line, the relatively large impact force on the bolt carrier causes torque or a twisting motion which causes the rear of the bolt carrier and the guide rails at the front of the bolt carrier to dig into the upper receiver often resulting in impact damage. This impact damage causes excessive wear and jamming. Additionally, these prior gas tappet systems often utilize a gas cylinder and piston having a coaxially attached operating rod coaxially that often results in the gas cylinder being taller than the original gas tube in a direct gas system. Therefore, often further modifications of the firearm are required. These further modifications often require new hand guards and sometimes replacement of the front sight base which makes the modification to the firearm expensive and complicated and often requires sophisticated tooling and equipment.

Therefore, there is a need for a gas tappet system that can be easily installed into M-16, M-4 and AR-15 type rifles without any or limited modification to the rifle. Additionally, there is a need for the design to substantially reduce the impact force applied to the bolt carrier and therefore reduce or eliminate the excessive torque or twisting that can cause excessive wear and possible jamming.

SUMMERY OF THE INVENTION

The present invention is a gas tappet system that may be easily and quickly used to retrofit or be installed in existing M-16, M-4 or AR-15 type rifles or firearms with no machining or irreversible modifications to the rifle or firearm. Upon removal of the original direct gas tube in the firearm or rifle, a cylinder having an offset gas tube is placed within the firearm such that the offset gas tube receives gas from a gas port in the barrel. The cylinder has a piston having a front plenum therein. The piston is detachably connected to an operating rod non-coaxially. That is, the operating rod is eccentrically detachably connected to the piston. The other end of the operating rod is attached to a bolt carrier. A mounting clamp is used to hold the cylinder on to the barrel of the firearm. The mounting clamp has a latch that permits the piston to be removed from the rear of the cylinder and detached from the operating rod as well as permitting the cylinder to be detached from the mounting clamp.

Accordingly, it is an object of the present invention to provide a more reliable ejection system for an automatic or a semi-automatic rifle.

It is another object of the present invention to minimize or eliminate the modifications necessary to the firearm in order to install the gas tappet system of the present invention.

It is yet another object of the present invention to prevent contamination from combustion or propellant gasses from creating excessive wear or causing jamming of the firing mechanism.

It is an advantage of the present invention that it has a gentler power stroke, thereby reducing impulse forces and damage to the firearm parts.

It is an advantage of the present invention that it is easy to disassemble and clean.

It is a further advantage of the present invention that it is easily installed into a firearm and permits the easy replacement of the original direct gas system of an M-16, M-4 or AR-15 type rifle with no irreversible modifications.

It is a feature of the present invention that a plenum or a space is formed in the front of the piston.

It is another feature of the present invention that the piston is detachable from the operating rod.

It is another feature of the present invention that the operating rod is eccentrically detachably connected to the piston and that a gas tube is eccentrically connected to the front of the cylinder.

These and other objects, advantages, and features will become more readily apparent in view of the following detailed description.

BRIEF DESCRIPTION OF THE PREFERRED EMBODIMENTS

Figure 1:
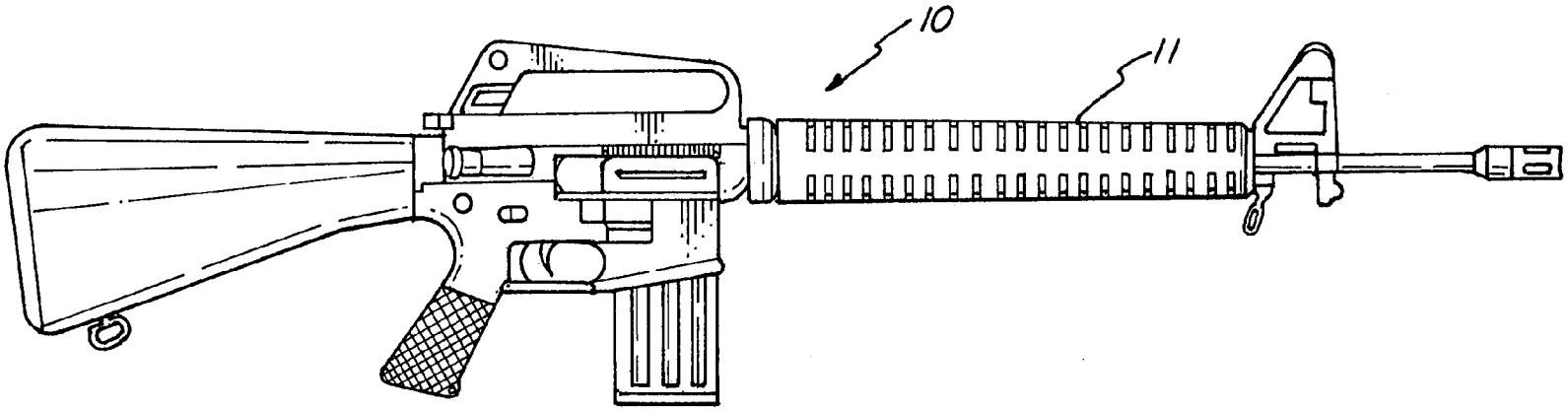
FIG. 1 is an elevational view illustrating an M-16, M-4, or AR-15 type rifle or firearm.

FIG. 1 illustrates a M-16, M-4 or AR-15 type rifle 10 having a hand guard or cover 11 in place over the barrel. The present invention is intended to be applicable to M-16, M-4, or AR-15 type rifles that have a direct gas impingement system or actuation. The present invention can be installed onto the rifle with little or no modification making it possible to remove the present invention and reinstall the original direct gas impingement system.

Figure 2:
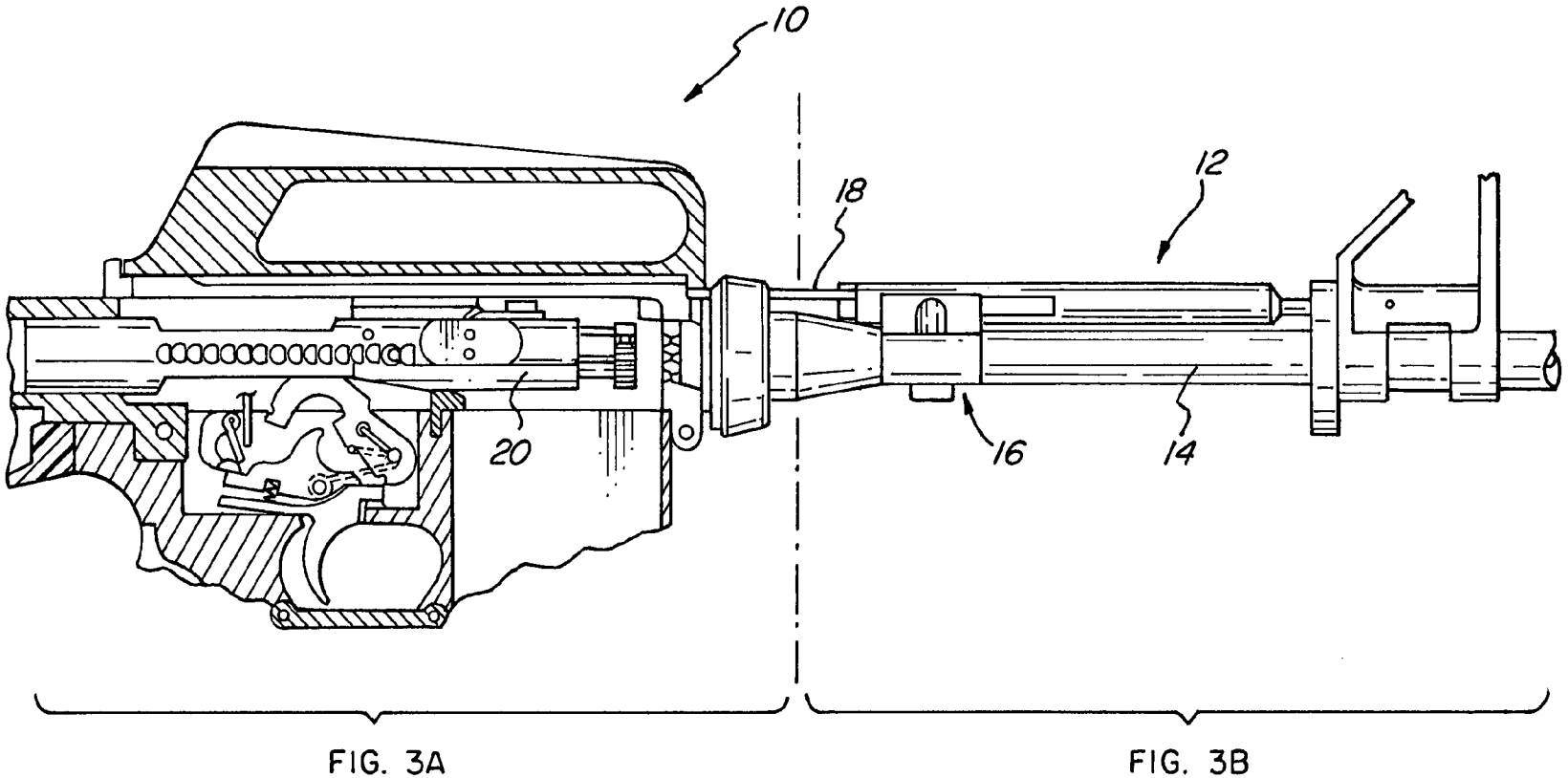
FIG. 2 is a partial cross section illustrating a part of a rifle.

FIG. 2 illustrates a portion of the rifle 10 divided into two sections, one section more clearly illustrating the bolt carrier 20 and the other section more clearly illustrating the gas tappet system 12 of the present invention placed on the barrel 14 and held by mounting clamp 16. Additionally illustrated is the operating rod 18 that is connected to the bolt carrier 20.

Figure 3A:
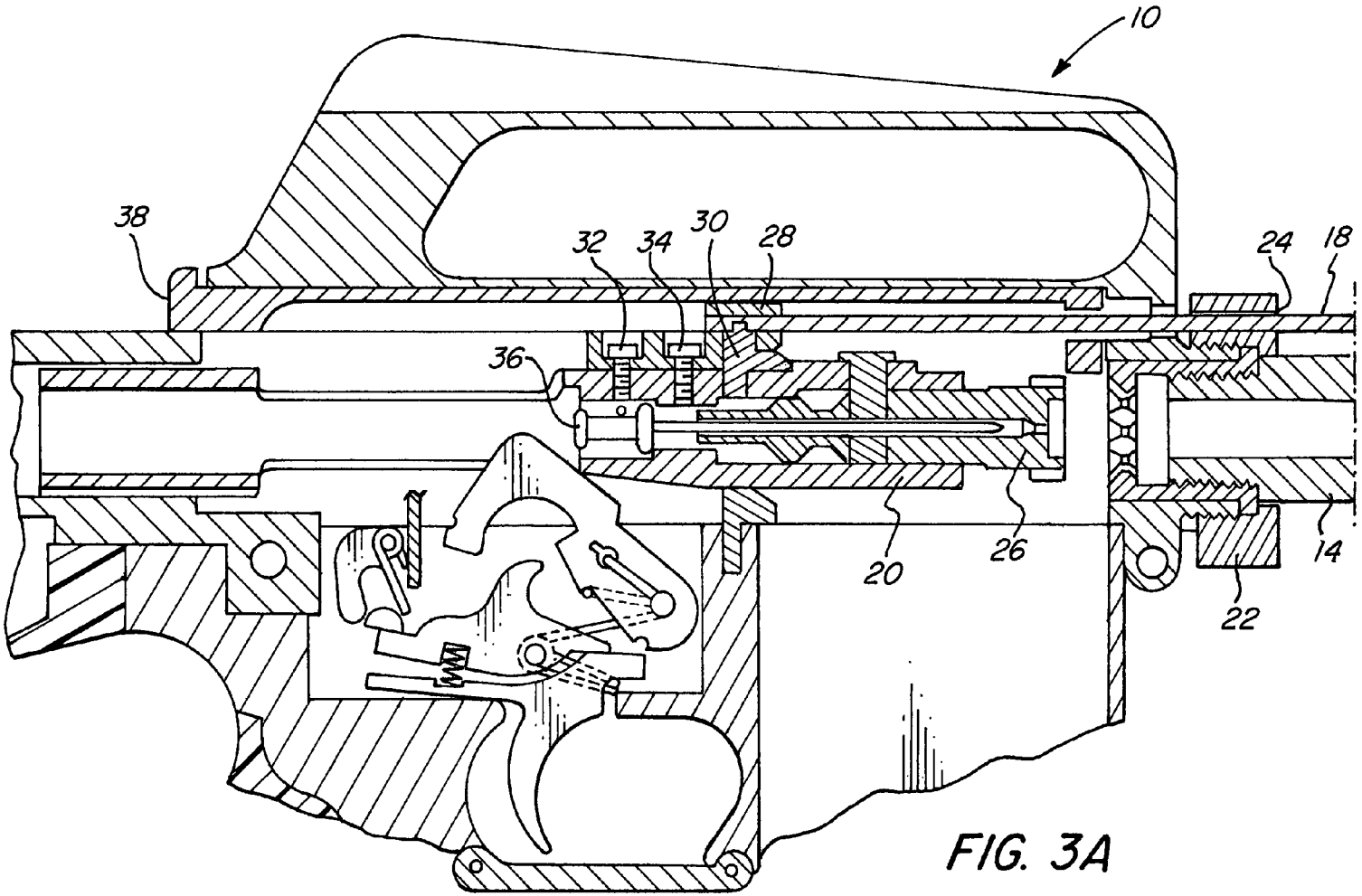
FIG. 3A is a cross section of a portion of the rifle illustrated in FIG. 2.

FIG. 3A more clearly illustrates the bolt carrier 20 and the operating rod 18. One end of the operating rod 18 is coupled to a piston and the other end of the operating rod 18 is attached to the bolt carrier 20, as illustrated in FIG. 3A. The barrel 14 of the rifle is attached by a barrel retaining nut 22. The barrel retaining nut 22 has a bore 24 therein through which the operating rod 18 passes. The bore 24 is the bore through which the original direct gas tube would pass in the original direct gas impingement system. Therefore, the bore 24 does not need to be modified in any way to receive the replacement operating rod 18 of the gas tappet system of the present invention. One end of the operating rod 18 is attached to the bolt carrier 20 through a carrier key 28 and a rod lock 30. The carrier key 28 is attached to the bolt carrier 20 by screws 32 and 34. The rod lock 30 helps to transmit forces from the operating rod 18 thereby providing less sheer forces on the screws 32 and 34. The operating rod 18 is moved axially rearward toward the handle of the rifle moving the bolt carrier 20. The bolt 26 and firing pin 36 are contained within the bolt carrier 20. Charging handle 38 is also illustrated.

Figure 3B:
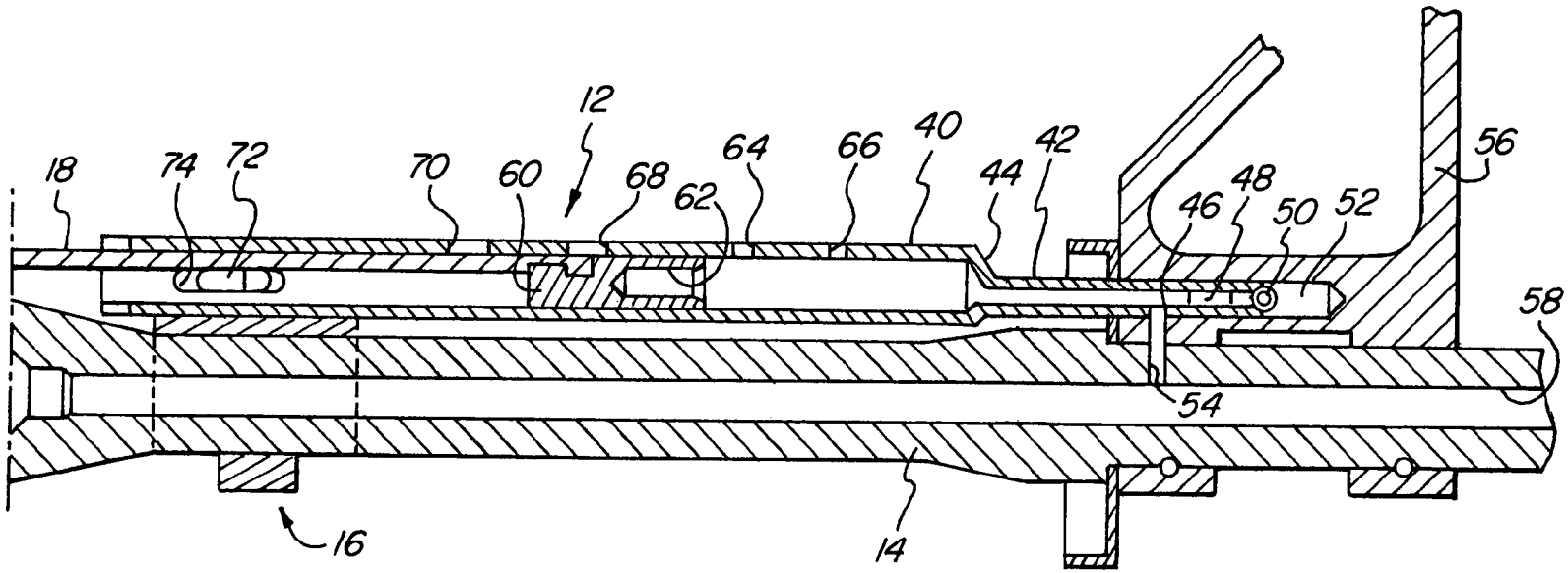
FIG. 3B is a cross section of a portion of the rifle illustrated in FIG. 2.

FIG. 3B is a cross section more clearly illustrating the gas tappet system 12 of the present invention. The gas tappet system 12 is attached to the barrel 14 of a rifle by mounting clamp 16. Within cylinder 40 is placed a piston 60. The piston 60 is releasably connected to the operating rod 18. The other end of the operating rod 18 is connected to the bolt carrier, illustrated in FIGS. 3A and 2. The front end of piston 60 has a plenum or space 62. The gas tube 42 is attached to the front of the cylinder 40 by end wall 44. The longitudinal axis of the gas tube 42 is not coaxial with the longitudinal axis of the cylinder 40. The gas tube 42 has a plug 48 at one end sealing it and is located within the bore 52 by pin 50. The bore 52 is the original front sight base bore utilized in the original direct gas impingement system which received the original gas tube which has been replaced by the present gas tappet system 12 of the present invention. Accordingly, no modifications need be made to the rifle to install the gas tappet system 12 of the present invention. The opening 46 is formed within the gas tube 42 mates with or is open to the gas port 54. The gas port 54 is open to the interior of the rifle bore 58. Accordingly, combustion or propellant gasses from the firing of a round are permitted to travel through the gas port 54 and into the gas tube 42 so as to drive piston 60 rearward, forcing the operating rod 18 rearward, moving the bolt carrier 20 rearward toward the handle of the rifle. The front site base 56 having the bore 52 therein may be utilized with the present invention without any modification.

The cylinder 40 has round gas ports 64 and 66 therein to exhaust propellant gasses, reducing the force on the piston 60. Preferably, the round gas ports 64 and 66 are placed adjacent to openings within a hand guard or cover, permitting ready release of the combustion or propellant gasses. Oblong gas ports 68 and 70 are also formed within the cylinder 40 to more completely exhaust the combustion or propellant gasses after the piston 60 has moved sufficiently rearward, after which the piston 60 may be cycled back towards the front of the rifle. The cylinder 40 also has a cylinder latch slot 74 placed therein, through which a latch 72 that is connected to the mounting clamp 16 may be positioned. The latch 72 when placed within the cylinder latch slot 74 holds cylinder 40 in place on the mounting clamp 16 on the barrel 14. Both the longitudinal axis of the gas tube 42 and operating rod 18 are not coaxial with the longitudinal axis of the cylinder 40 or the piston 60. This facilitates the positioning of the gas tappet system 12 of the present invention so as to prevent the need of any modifications to the rifle upon the installation of the gas tappet system 12 of the present invention.

The cylinder 60 may be placed in a position very near the end wall 44 and may be positioned slightly away from the end wall 44 so as to form a space. Accordingly, the combination of a slight space between the cylinder 60 and the end wall 44 and the plenum 62 formed in the front of the piston 60 results in a volume or initial space being formed prior to the combustion or propellant gases entering gas port 54 and into the gas tube 42. This initial space or volume acts to provide an initial charge of pressurized gas so as to render the action of the piston 60 smoother and provides a longer stroke with less impact. Therefore, there is a sufficient charge of pressurized gas within the cylinder 40 so that when the bullet exits the muzzle of the rifle and leaves the rifle bore 58, resulting in a drop in pressure within the rifle bore 58, there is sufficient gas pressure within the cylinder 40 so as to smoothly push backward the piston 60 and attached operating rod 18 so as to move the attached bolt carrier 20, illustrated in FIGS. 2 and 3A. Therefore the present invention has a longer, smoother stroke that avoids stresses and strains and potential damage to the bolt carrier. Additionally, due to the reduction of a sudden impact to the bolt carrier 20, less torque is produced resulting in less wear and tear on the firing mechanism of the rifle.

Figure 4:
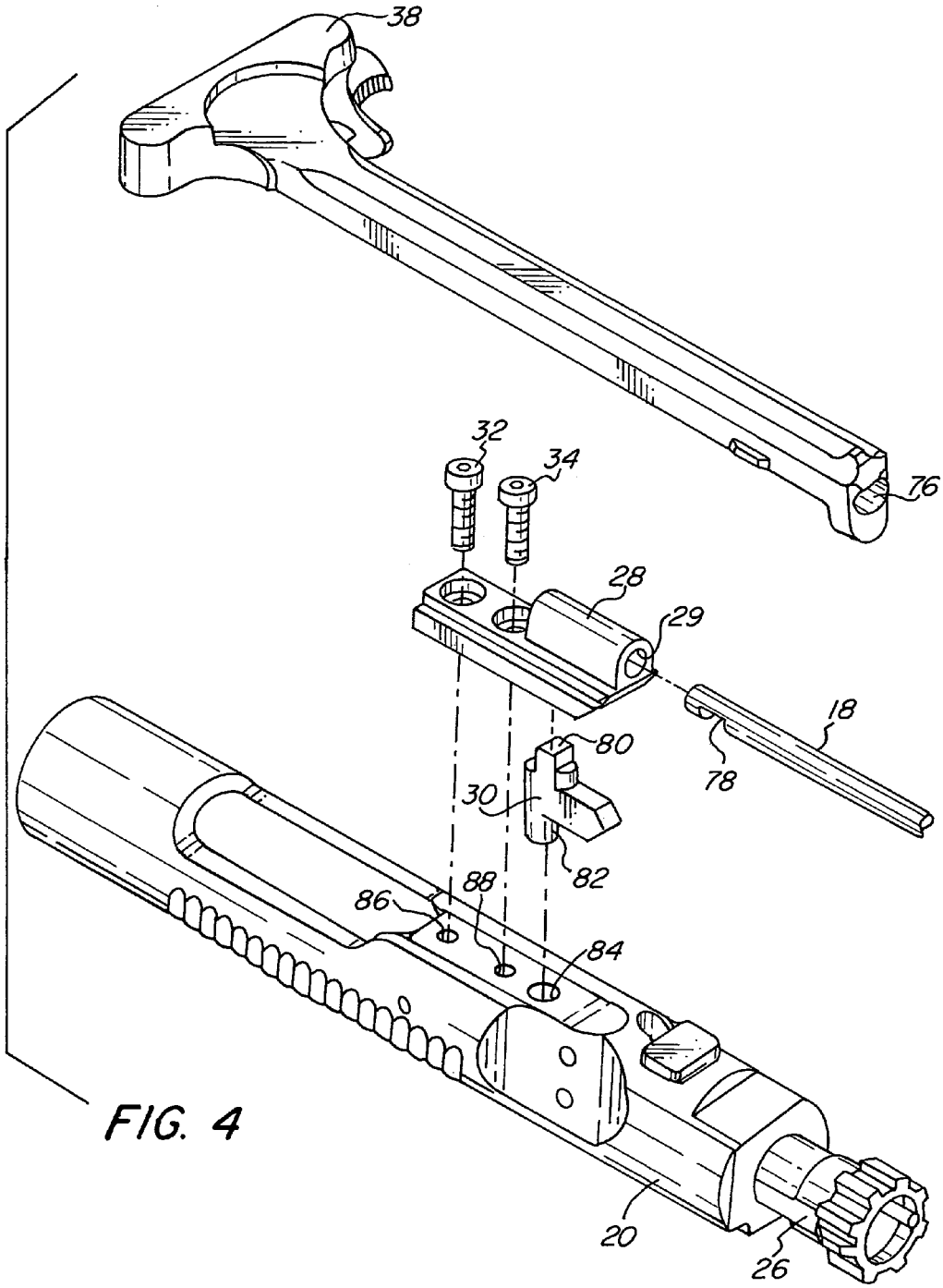
FIG. 4 is an exploded view illustrating a portion of the rifle illustrated in FIG. 3A.

FIG. 4 is an exploded view illustrating more clearly the assembly of a portion of the bolt carrier 20 illustrated in FIG. 3A. The operating rod 18 has a notch 78 therein. The operating rod 18 is placed within the bore 29 formed within the carrier key 28. A rod lock 30 having a key 80 extends into the carrier key 28 such that the key 80 mates with the notch 78 in the operating rod 18. The rod lock 30 has a stem 82 that fits within the hole 84 in the bolt carrier 20. The hole 84 is the hole originally used by the original direct gas tube impingement system, which the gas tappet system of the present invention replaces. The carrier key 28 is held on to the bolt carrier 20 by screws 32 and 34 placed within tapped holes 86 and 88. The hole 76 on the charging handle 38 receives the operating rod 18 when assembled. The bolt 26 is held within the bolt carrier 20. Accordingly, the rod lock 30 greatly aids in reducing the sheer forces on the screws 32 and 34.

Figure 5:
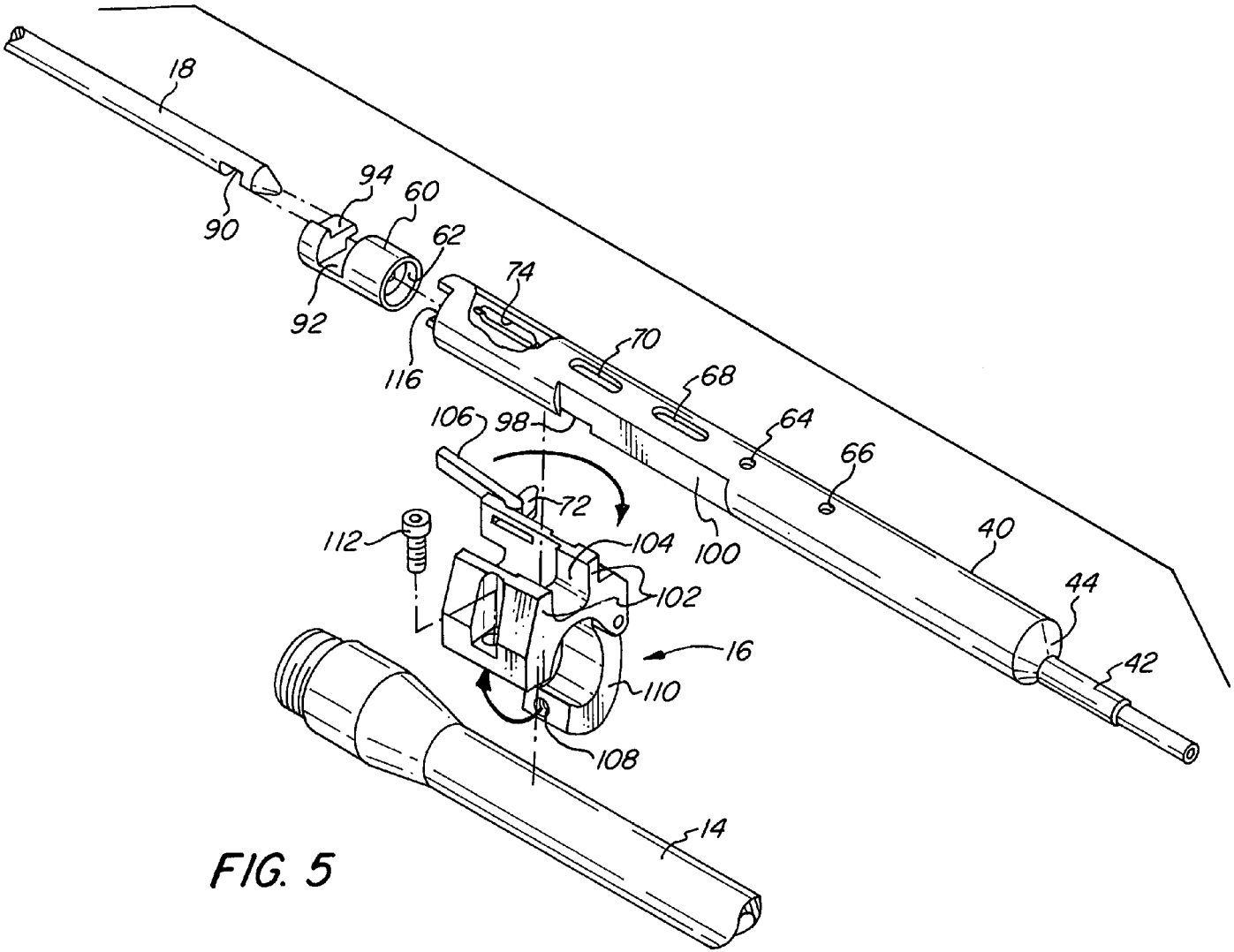
FIG. 5 is an exploded view illustrating a portion of the rifle illustrated in FIG. 3B.

FIG. 5 is an exploded view more clearly illustrating the mounting clamp 16 and attachment to the cylinder 40 in cooperation with the piston 60. The mounting clamp 16 is attached to the barrel 14 with a bottom clamp arm 110 that pivots around the barrel 14 and is secured in place with clamp screw 112 which threads into tapped hole 108 on the bottom clamp arm 110. Accordingly, the mounting clamp 16 may be placed on the barrel 14 and securely held without any modification to the barrel 14. The mounting clamp 16 has side walls 102 and a ridge 104. The side walls 102 are adapted to fit within the side flat 100 formed on either side of the cylinder 40. A bottom flat 98 is formed on the cylinder 40 so as to be securely held between the ridge 104 and the forward end of the mounting clamp 16. Accordingly the cylinder 40 having the side flats 100 may be placed between the side walls 102 of the mounting latch 16 and then slid through the side walls 102 until the bottom flat 98 mates with the ridge 104 and the end of the mounting clamp 16. This permits the gas tube 42 to be placed within the bore 52, in the front sight base 56 as illustrated in FIG. 3B. As a result, the cylinder latch slot 74 is positioned adjacent the clamp latch slot 114 in mounting clamp 16. This permits the latch 72, upon rotation of the latch handle 106, to extend into the clamp latch slot 114 and into the cylinder latch slot 74 so as to securely hold the cylinder 40 within the mounting clamp 16. The latch 72 and attached latch handle 106 may have multiple positions such that when the latch handle 106 is positioned at approximately ninety degrees the latch 72 does not extend into the cylinder latch slot permitting the cylinder 40 to be removed from the mounting clamp 16. When the latch handle 106 is placed at approximately forty-five degrees the latch 72 extends into the cylinder latch slot 74 so as to hold the cylinder 40 within the mounting clamp 16 and yet does not extend into the interior of the cylinder 40 so that the piston 60 can be moved rearward axially, passing the latch 72 and permitting the piston 60 to be moved laterally passed the cylinder sidewall partial cutaway 116. This permits the piston 60 to be moved laterally so that the notch 90 in the operating rod 18 is slid over the flat 94 disengaging the operating rod 18 from the lateral channel 92 formed in the piston 60. The structure illustrated in FIG. 5 permits the cylinder 40 to be securely held with the mounting clamp 16 onto the barrel 14 and yet permits easy disassembly of the cylinder 40 and piston 60 for cleaning or removal.

Figure 6B:
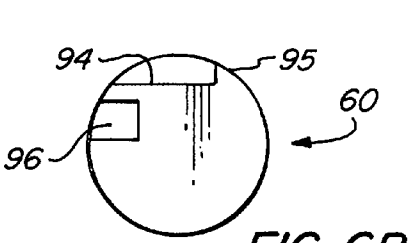
FIG. 6B is a rear elevational view of the piston.
Figure 6A:
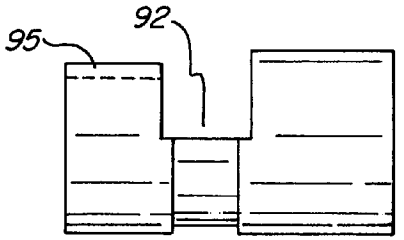
FIG. 6A is a side elevational view of the piston.
Figure 6D:
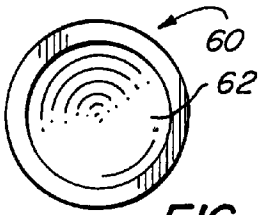
FIG. 6D is front elevational view of the piston.
Figure 6C:
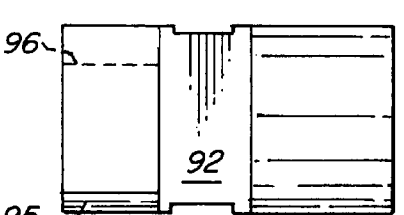
FIG. 6C is a top plan view of the piston.

FIGS. 6A-D more clearly illustrate the piston 60 of the present invention. In FIG. 6A the lateral channel 92 can clearly be seen. FIG. 6B is an end view more clearly illustrating the latch groove 96 and the flat 94 that has a stop 95. FIG. 6C is a top plan view of the piston 60. FIG. 6D is a front end view of the piston 60 illustrating the plenum 62.

Figure 7A:
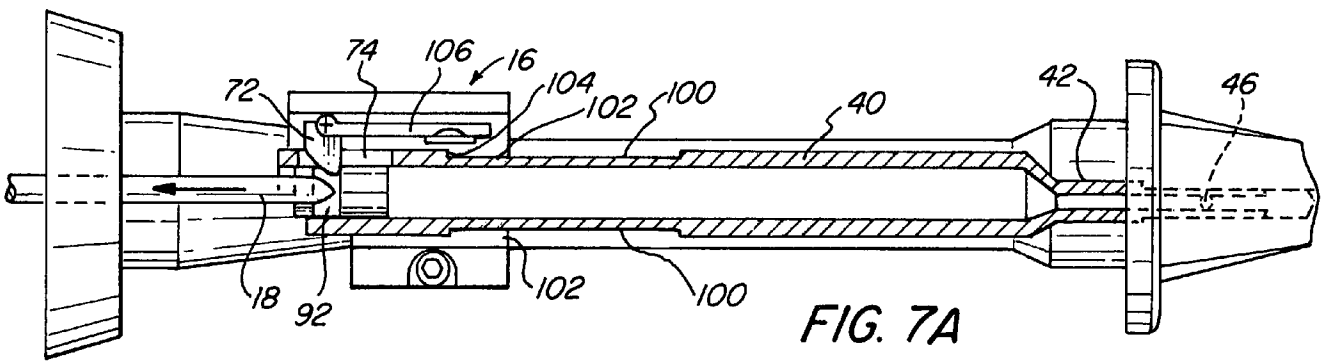
FIG. 7A is a top plan view illustrating the operation of the mounting clamp and latch.

FIGS. 7A-D more clearly illustrate the mounting clamp 16 with its associated latch 72 and its operation with the piston 60 of the present invention. In FIG. 7A, the mounting clamp 16 has the latch handle 106 in the closed position resulting in the latch 72 extending through the latch slot 74 into the interior of the cylinder 40, contacting one sidewall of the lateral channel 92. Accordingly, the piston 60 cannot be removed from the cylinder 40 and the operating rod 18 is not forced back any further. The latch 72 extends into the latch groove 96 illustrated in FIGS. 6B and 6C. It should be noted that the recess 105 formed in the latch handle 106 and the side of the mounting clamp 116 is adapted to receive the rim of a cartridge case so as to make opening of the latch handle 106 more convenient. FIG. 7A also more clearly illustrates the cylinder side flat portions 100 on either or opposing walls of the cylinder 40.

Figure 7B:
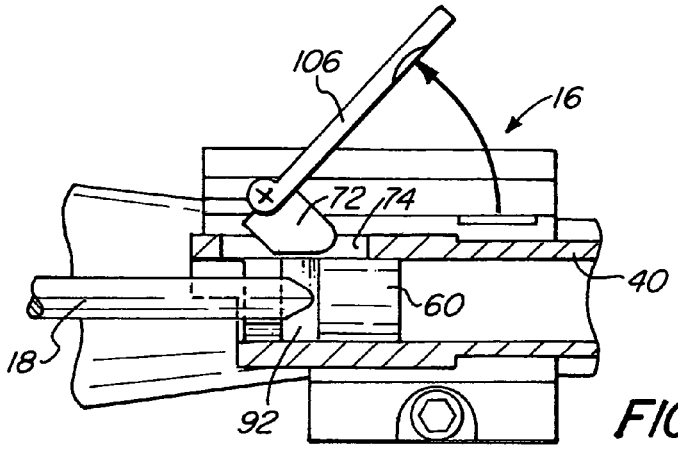
FIG. 7B is a top plan view illustrating the operation of the mounting clamp and latch in a position to permit the piston to be removed from the cylinder.

FIG. 7B illustrates the opening of the latch handle 106 approximately forty-five degrees so that the latch 72 is withdrawn from the interior of the cylinder 40 and extends into the latch slot 74. This permits the piston 60 to be moved further rearward towards the operating rod 18 so that the piston 60 moves past the latch 72.

Figure 7C:
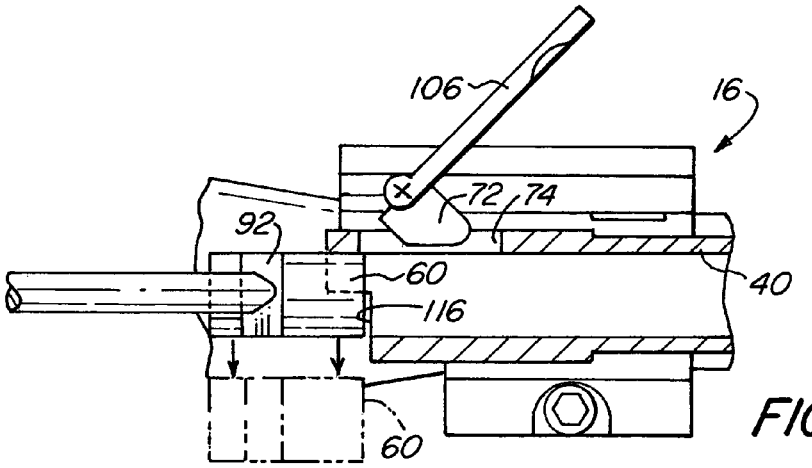
FIG. 7C is a top plan view illustrating the removal of the piston from the cylinder and disengaging the piston from the operating rod.

FIG. 7C illustrates the piston 60 being moved rearward past the latch 72 and past the cylinder sidewall partial cutaway 116 so that the piston 60 can be moved laterally out of the cylinder 40. By moving the piston 60 laterally, the end of the operating rod 18 is released from the channel 92 so that the piston 60 can readily be removed from the cylinder 40. In the latch 72 position illustrated in FIGS. 7B and 7C, the piston 60 is permitted to move past the latch 72 and yet the latch 72 is in position within the cylinder latch slot 74 so as to hold the cylinder 40 in place on the mounting clamp 16.

Figure 7D:
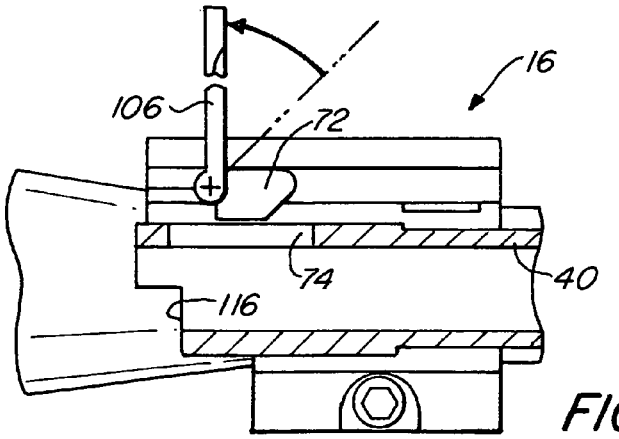
FIG. 7D is a top plan view illustrating the operation of the mounting clamp and latch in a position to permit the cylinder to be removed from the mounting clamp.

FIG. 7D illustrates the latch handle 106 in a ninety degree open position such that the latch 72 is fully withdrawn from the cylinder latch slot 74. With the latch handle 106 in this position, the cylinder 40 can readily be removed from the mounting clamp 16. Accordingly, the gas tappet system of the present invention can readily be disassembled from the firearm for cleaning or removal of the gas tappet system completely, and reinstallation of the original direct gas system, if desired.

The operation of the gas tappet system 12 of the present invention can readily be appreciated with reference to the drawings. The gas tappet system of the present invention is utilized to provide automatic or semi-automatic fire by cycling rounds automatically. When a round is fired, combustion or propellant gasses force the bullet through the rifle bore 58. As the bullet and expanding propellant gasses pass the gas port 54, combustion or propellant gasses enter gas port 54 and travel down gas tube 42, entering a small volume of space between the end wall 44 and the piston 60 with the plenum 62 forcing the piston 60 rearward, driving the operating rod 18 rearward towards the handle of the rifle. The operating rod 18, being attached to the bolt carrier 20 forces it rearward to cycle another round. The gas tappet system of the present invention replaces the original direct gas impingement system which utilizes a gas tube and gas directly to force rearward bolt carrier 20 to cycle a round. Accordingly, the present invention has the advantage of containing hot and corrosive combustion or propellant gasses within the cylinder and prevents excessive contamination or wear and tear on the firing mechanism of the firearm. Accordingly, the present invention is particularly advantageous in harsh environments where sand, fine particles, or dirt may enter the rifle and mix with the combustion or propellant gasses and lubricants, resulting in excessive wear or jamming of the firing mechanism. Additionally the gas tappet system of the present invention can easily be installed without substantial modification or irreversible modification of the rifle. The gas tappet system of the present invention can be installed easily and conveniently to improve performance of the rifle, and yet be easily removed and placed back in its original condition, if desired. Therefore, when desired the gas tappet system of the present invention may be removed and the original direct gas tubing reinstalled in the rifle, placing it in its original condition.

Although the preferred embodiment has been illustrated and described, it will be obvious to those skilled in the art that various modifications may be made without departing from the spirit and scope of this invention.

What is claimed is:

1. A gas tappet system for a rifle comprising:

a gas cylinder having a longitudinal axis and a gas tube end and an open end;

a tube extending from the gas tube end of said gas cylinder having an axis parallel to and offset from the longitudinal axis, whereby said tube is adapted to mate with a gas port in the rifle;

a piston placed in the gas cylinder; and an operating rod having a proximal end laterally slidably coupled non-coaxially to said piston and extending out of the open end of said gas cylinder, wherein a distal end of said operating rod is adapted to be coupled to a bolt carrier of the rifle, whereby an original direct gas impingement system of the rifle may be converted to the gas tappet system.

2. A gas tappet system for a rifle comprising:

a gas cylinder having a longitudinal axis and a gas tube end and an open end;

a tube extending from the gas tube end of said gas cylinder and offset from the longitudinal axis, whereby said tube is adapted to mate with a gas port in the rifle;

a piston placed in the gas cylinder;

an operating rod having a proximal end coupled non-coaxially to said piston and extending out of the open end of said gas cylinder, wherein a distal end of said operating rod is adapted to be coupled to a bolt carrier of the rifle, and wherein said piston comprises a lateral channel and said operating rod further comprises a notch adjacent the proximal end, wherein the proximal end is adapted to mate with the lateral channel, whereby an original direct gas impingement system of the rifle may be converted to the gas tappet system.

3. A gas tappet system for a rifle as in claim 2 wherein:

said piston has a plenum in an end opposite the lateral channel.

4. A gas tappet system for a rifle as in claim 2 further comprising:

a carrier key receiving the distal end of said operating rod, the distal end of said operating rod having a distal end notch; and a rod lock having a key adapted to fit within the carrier key and the distal end notch of said operating rod and a stem adapted to fit within a hole in the bolt carrier of the rifle, whereby said carrier key is attached to the bolt carrier of the rifle and said rod lock aids in absorbing impact loads from said operating rod.

5. A replacement gas tappet system for a rifle comprising:

a cylinder having an open end, an end wall, and a first longitudinal axis;

a gas tube having a second longitudinal axis mounted on the end wall, wherein the first longitudinal axis is offset from the second longitudinal axis, said gas tube having an opening adapted to mate with a gas port in a barrel of the rifle;

a piston placed within said cylinder, said piston having a plenum on one end and a lateral channel and a flat portion between the lateral channel and the other end;

an operating rod having a proximal end notch on a proximal end, the proximal end adapted to mate with the lateral channel and the flat portion in said piston adapted to mate with the proximal end notch, a distal end of said operating rod connected to a bolt carrier of the rifle; and a mounting clamp attached to said cylinder and a barrel of the rifle, whereby an original direct gas impingement system of the rifle may be replaced with the replacement gas tappet system.

6. A replacement gas tappet system for a rifle as in claim 5 further comprising:

a cylinder sidewall partial cutaway adjacent the open end of said cylinder; and a cylinder latch slot formed in said cylinder, whereby said piston may be removed from said cylinder adjacent said cylinder sidewall partial cutaway.

7. A replacement gas tappet system for a rifle as in claim 6 further comprising:

gas ports formed in said cylinder.

8. A replacement gas tappet system for a rifle as in claim 7 wherein:

said gas ports comprise round gas ports and oblong gas ports.

9. A replacement gas tappet system for a rifle as in claim 7 wherein:

said gas ports are positioned over holes in an interior surface of a hand guard, whereby operation of the M16, M4, or AR-15 type rifle results in less propellant gas residue accumulation and less heat being transferred to upper and lower receives and action.

10. A replacement gas tappet system for a type rifle as in claim 5 further comprising:

a carrier key receiving the distal end of said operating rod, the distal end of said operating rod having a distal end notch; and a rod lock having a key adapted to fit within the carrier key and the distal end notch of said operating rod and a stem adapted to fit within a hole in the bolt carrier of the M16, M4, or AR-15 type rifle, whereby said carrier key is attached to the bolt carrier of the M16, M4, or AR-15 type rifle and said rod lock aids in absorbing impact loads from said operating rod.

11. A replacement gas tappet system for a rifle as in claim 6 wherein said mounting clamp comprises:

a bottom clamp pivoted arm fixed by a screw;

side walls forming a U-shape having an intermediate ridge;

a clamp latch slot formed in one of said side walls;

a latch adapted to fit through said clamp latch slot;

a handle attached to said latch and pivoting on said mounting clamp, said handle having a first, second, and third position, whereby in the first position said latch extends through said clamp latch slot and through said cylinder latch slot in said cylinder preventing said piston from passing, and in the second position said latch does not extend beyond said cylinder latch slot permitting said piston to pass, and in the third position said latch is removed from the cylinder latch slot permitting said cylinder to be removed from said mounting clamp.

12. A replacement gas tappet system for a type rifle as in claim 11 wherein:

said piston has a latch groove, whereby a portion of said latch extends into the latch groove permitting said piston to extend further rearward.

13. A replacement gas tappet system for a rifle as in claim 11 further comprising:

opposing cylinder flat portions placed on exterior walls of said cylinder and adapted to mate with said side walls of said mounting clamp; and a bottom cylinder flat placed between said opposing cylinder flat portions and adapted to mate with the intermediate ridge in said mounting clamp.

14. A replacement gas tappet system for a type rifle as in claim 11 further comprising:

a recess formed in said mounting clamp and said handle adapted to receive a rim of a cartridge case, whereby opening of said handle is facilitated.

15. A gas tappet system for replacing a direct gas impingement system used for automatically cycling a round in a rifle comprising:

a cylinder having an end wall, an open end, and a first longitudinal axis;

a cylinder sidewall partial cutaway adjacent the open end of said cylinder;

a cylinder latch slot formed in said cylinder;

a plurality of gas ports formed in said cylinder intermediate the end wall and the open end;

opposing cylinder flat portions placed on exterior walls of said cylinder;

a bottom cylinder flat placed between said opposing cylinder flat portions;

a gas tube having a second longitudinal axis mounted on the end wall of said cylinder, wherein the first longitudinal axis is offset from the second longitudinal axis, said gas tube having an opening adapted to mate with a gas port in a barrel of the rifle;

a piston placed within said cylinder, said piston having a plenum on one end and a lateral channel and a flat portion between the lateral channel and the other end;

an operating rod having a proximal end notch on a proximal end, the proximal end adapted to mate with the lateral channel and flat portion in said piston;

a carrier key receiving the distal end of said operating rod, the distal end of said operating rod having a distal end notch;

a rod lock having a key adapted to fit within the carrier key and the distal end notch of said operating rod and a stem adapted to fit within a hole in the bolt carrier of the rifle;

a mounting clamp attached to said cylinder and the barrel of the rifle, said mounting clamp comprising, a bottom clamp pivoted arm fixed by a screw;

side walls forming a U-shape having an intermediate ridge adapted to receive the bottom cylinder flat;

a clamp latch slot formed in one of said side walls;

a latch adapted to fit through said clamp latch slot; and a handle attached to said latch and pivoting on said mounting clamp, said handle having a first, second, and third position, wherein in the first position said latch extends through said clamp latch slot and through said cylinder latch slot preventing said piston from passing, and in the second position said latch does not extend beyond said cylinder latch slot permitting said piston to pass, and in the third position said latch does not extend beyond said clamp latch slot permitting said cylinder to be removed from said mounting clamp, whereby an original direct gas impingement system of the rifle may be modified with the replacement gas tappet system without any permanent modifications to the rifle.

16. A gas tappet system for replacing a direct gas impingement system used for automatically cycling a round in a rifle as in claim 15 wherein:

when assembled said piston is spaced from the end wall of said cylinder, whereby an additional volume is available for receiving a charge of propellant gas for smoothly moving said piston.

17. A gas tappet system for a rifle comprising:

a gas cylinder having a longitudinal axis and a gas tube end and an open end;

a tube extending from the gas tube end of said gas cylinder, whereby said tube is adapted to mate with a gas port in the rifle;

a piston placed in the gas cylinder;

a front plenum placed in a front end of said piston;

an operating rod having a proximal end laterally slidably coupled to said piston and extending out of the open end of said gas cylinder;

a carrier key attached to a bolt carrier of the rifle; and said operating rod having a distal end, the distal end attached to said carrier key, whereby said piston, said operating rod, said carrier key, and the bolt carrier move as a unit reducing a striking force on the bolt carrier.

18. A gas tappet system for a rifle as in claim 17 wherein:

said piston has a piston lateral channel and said operating rod has a proximal notch adjacent the proximal end, wherein the proximal end is adapted to mate with the piston lateral channel securing said piston longitudinally to said operating rod; and said operating rod has a distal notch adjacent the distal end wherein the distal end is adapted to mate with said carrier key and secured thereto by a rod lock.

* * * * *